United States Patent [19]

Kulkarni et al.

[11] Patent Number: 4,933,061

[45] Date of Patent: Jun. 12, 1990

[54] ELECTROPLATING TANK

[75] Inventors: Krishna Kulkarni, Pawtucket; Richard J. DiDonato, North Providence, both of R.I.

[73] Assignee: Trifari, Krussman & Fishel, Inc., East Providence, R.I.

[21] Appl. No.: 291,901

[22] Filed: Dec. 29, 1988

[51] Int. Cl.[5] ..... C25D 17/02; C25D 17/08; C25D 21/10

[52] U.S. Cl. ..... 204/224 R; 204/237; 204/269; 204/273; 204/274; 204/DIG. 7; 204/275; 204/297 W

[58] Field of Search ..... 204/228, 231, 273, 274, 204/275–278, 297 W, DIG. 7, 267–270, 224 R, 237

[56] References Cited

U.S. PATENT DOCUMENTS

| | | | |
|---|---|---|---|
| 2,675,348 | 4/1954 | Greenspan et al. | 204/297 W X |
| 2,751,340 | 6/1956 | Schaefer et al. | 204/297 W X |
| 3,023,154 | 2/1962 | Hough et al. | 204/297 W X |
| 3,437,578 | 4/1969 | Gibbs et al. | 204/297 W |
| 4,012,309 | 3/1977 | Eslien et al. | 204/297 W X |
| 4,113,586 | 9/1978 | Cook et al. | 204/297 R |
| 4,492,621 | 1/1985 | Stubb | 204/273 X |
| 4,500,394 | 2/1985 | Rizzo | 204/297 W X |
| 4,634,503 | 1/1987 | Nogavich | 204/275 X |

*Primary Examiner*—Donald R. Valentine
*Attorney, Agent, or Firm*—Blum Kaplan

[57] ABSTRACT

An electroplating apparatus for electroplating a plurality of items. The apparatus includes a tank having a bottom wall and side walls and adapted to hold a predetermined quantity of an electrolytic plating solution. A sparger system at the bottom of the tank directs the electrolytic plating solution in an upward direction. A cathode rack supporting the items to be electroplated extends intermediate to anode plates and upwardly from the sparger system. Strategically placed openings in the anodes and an anode screen in conjunction with the sparger system act to reduce the plating thickness variance over the rack.

22 Claims, 8 Drawing Sheets

ELECTRICAL CONTROL UNIT
38

88
FLOW METER
22
36
87
34
26
74
24
28
40
42
80
44
46
48
82
50
122
60
202
71
112
60a
73
142
152
102
500
132
60b
73
70a
500'
71
74
72
72a
130
200
70
122
132
152
102
100
400
150
400'
120
73
71
112
142
152
3
200'
132
60
3
102
71
122
24a
202a

ELECTROPLATING TANK

BACKGROUND OF THE INVENTION

The present invention is directed generally to an electroplating tank and, in particular, to an improved electroplating tank for electroplating items of jewelry or the like with gold or other metals on a rack fixture with improved uniformity of plating thickness distribution over items on the rack.

The process of electroplating of jewelry is generally performed utilizing a variety of electrolytic solution formulations in either rotating barrels or on rigid rack fixtures. The rack fixture method is used more commonly on delicate or highly polished items and constitutes a major portion of electroplating jewelry production. The electroplating process is utilized throughout the decorative jewelry industry to deposit layers of copper, nickel, gold, rhodium, silver and like metals onto jewelry items to provide an aesthetic appearance, and corrosion wear resistance characteristics, thereby insuring and enhancing the quality, appearance and value of the products.

In a conventional electroplating tank, the items of jewelry to be plated are wired onto a rack fixture which forms the negative terminal or cathode of the tank. Multiple rows and columns of jewelry are strung on the rack. An electrical field is created in the chemical plating solution between the rack which forms the cathode, and positive terminals or anodes.

The electrolyte solution is rich in the ions of the metal to be plated. Some of the metal ions in the electrolyte solution adjacent the parts to be plated are deposited onto the items on the rack and are electrically neutralized. Prior art patents which describe conventional plating techniques include U.S. Pat. Nos. 4,115,213, 4,174,261, 4,385,967, 4,595,478 and 4,634,503.

In conventional tanks, rack-fixtured jewelry items have the inherent problem of non-uniformity in the thickness of the deposited metal from item to item on the rack. This is due primarily to the non-uniform electrical field created between the positive terminals or anodes and the negative terminal or cathode when an electrical direct current (DC) is directed through the electroplating chemical solution. The field strength of the electrical field is higher on the edges of the rack as compared to the strength of the field at the central areas of the rack, thereby resulting in a lower metal plating thickness at the center of the rack and a higher metal plating thickness at the rack edges.

Such non-uniformity in electrical fields is directly apparent in the non-uniformity of jewelry items plated in a conventional system. Apart from the quality problems inherent in non-uniform coating procedures, where gold or other expensive metals are to be plated, substantial increased costs are realized through the wasting of the gold. In other words, since sufficient gold must be deposited on all items on the rack, the jewelry pieces at the rack edges receive a plating of more gold than is necessary for quality control standards in order to insure that jewelry items in the center of the rack are sufficiently plated.

It has been found that conventional gold electroplating tanks often suffer from a thickness distribution variance of more than about 11.5%. If this percentage could be reduced even slightly, significant cost savings could be realized immediately.

Accordingly, it is desired to provide an improved electroplating tank which overcomes the problems inherent in prior art constructions which provides a more uniform distribution of deposited metal from item to item on the plating rack.

SUMMARY OF THE INVENTION

Generally speaking, in accordance with the present invention, an electroplating apparatus is provided. The electroplating apparatus includes a tank having a bottom wall and side walls and adapted to hold a predetermined quantity of an electrolytic plating solution such as an acid gold solution. A heating coil may be positioned proximate the bottom wall of the tank for heating the electrolytic plating solution to a predetermined temperature. A sparger system also positioned proximate the bottom wall of the tank directs the electrolytic plating solution in a direction generally parallel to the side walls of the tank. A pumping mechanism is coupled to the sparger system for circulating the electrolytic plating solution through the sparger system. An electrically conductive rack supports a plurality of items, such as jewelry, in a plurality of rows and columns. A support rod positioned in the tank releaseably supports the rack to extend upwardly from the sparger system. First and second anodes are positioned on opposite sides of the rack and extend essentially parallel thereto. A screen for directing and focusing current from the anodes to the rack is positioned intermediate the rack and one of the anodes. A voltage source applies a predetermined voltage across the first and second anodes and the rack which acts as a cathode to electrically deposit the metal in the plating solution on the items on the rack.

In a preferred embodiment, the tank includes a double system of components to permit two racks of jewelry to be plated in a single tank. Elongated laterally extending openings of various lengths and widths are provided in the anodes. The screen is preferably formed from a non-conductive material such as polypropylene and includes openings configured to properly direct the current flowing between the anodes and cathode rack.

Accordingly, it is an object of the present invention to provide an improved electroplating tank.

Another object of the present invention is to provide an improved electroplating tank which minimizes non-uniformity of plating thickness over a rack of items.

A further object of the present invention is to provide an electroplating apparatus in which two racks of jewelry items can be plated in a single plating tank simultaneously with a more uniform distribution of electrochemically deposited metal on both racks.

Yet another object of the present invention is to provide for the processing of jewelry items of different sizes, shapes and configurations, with a more uniform distribution of electrochemically deposited metal from item to item.

Still other objects and advantages of the invention will in part be obvious and will in part be apparent from the specification.

The invention accordingly comprises the features of construction, combination of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 1:
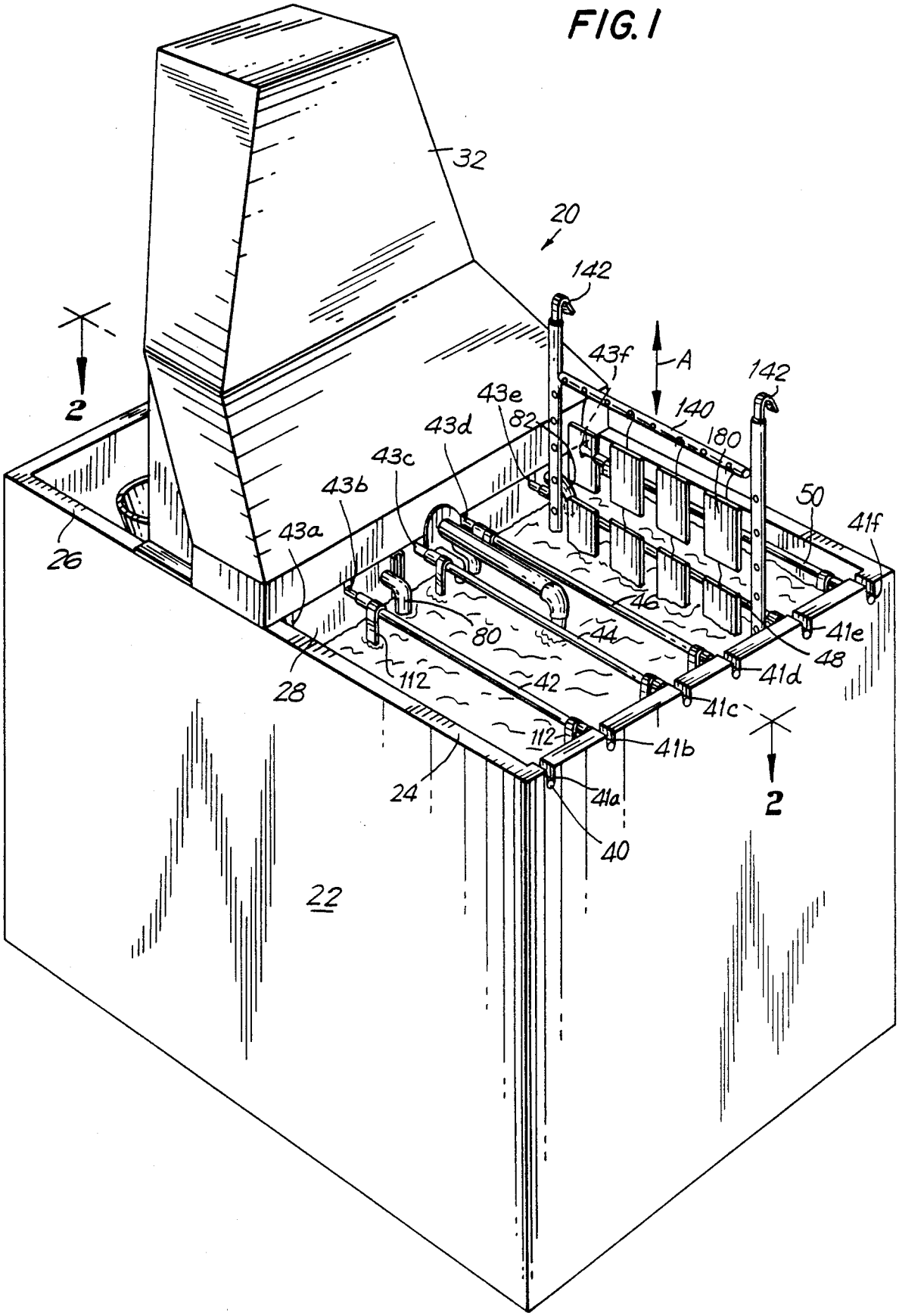
FIG. 1 is a perspective view of an electroplating apparatus constructed in accordance with a preferred embodiment of the present invention.

Reference is first made to FIG. 1 which depicts an electroplating apparatus, generally indicated at 20, and constructed in accordance with a preferred embodiment of the present invention. Electroplating apparatus 20 includes an electroplating tank 22 defining a front tank compartment 24 and a rear tank compartment 26. A plate 28 preferably formed from a plastic material such as polypropylene divides electroplating tank 22 into its front compartment 24 and rear compartment 26. Tank 22 is preferably formed of a non-conductive plastic material such as polypropylene.

Figure 2:
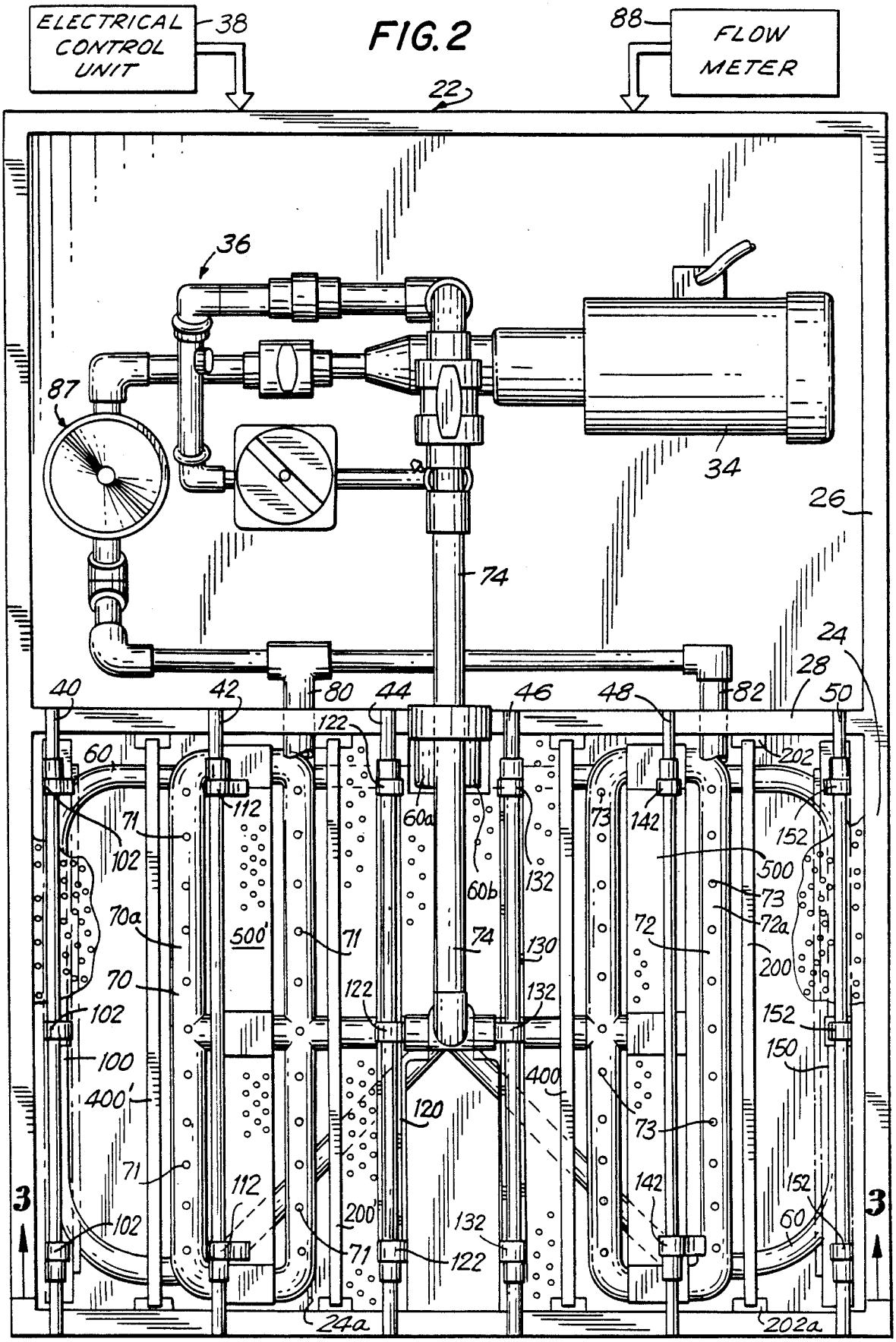
FIG. 2 is an enlarged sectional view taken along 2—2 of FIG. 1.

Tank 24 is adapted to hold a predetermined amount of an electrolytic plating solution 30 such as an acid gold plating solution. Referring to FIG. 2, it is seen that rear tank compartment 26 has approximately the same volume as front tank compartment 24. Hence, should a leak occur in the front compartment, the rear compartment 26 along with the outer shell of the tank will contain the full volume of the plating solution. A hood 32 is also provided intermediate front compartment 24 and rear compartment 26 and provides the necessary venting components for the system.

As best depicted in FIG. 2, rear compartment 26 also houses a circulation pump 34 and piping system, generally indicated at 36, for circulating electrolytic solution 30 as described in detail below. Piping system 36 also includes appropriate filters and valves to insure proper pumping. An electrical control unit 38 such as a rectifier control unit of constant current density is positioned outside of rear compartment 26 to provide the necessary electrical connections for powering the system as described below.

A series of six (6) conductive supporting rods 40, 42, 44, 46, 48 and 50 are supported within slots 41*a* through 41*f* and 43*a* through 43*f*, respectively, so as to extend laterally across the top of tank 24. Each of rods 40, 42, 44, 46, 48 and 50 are appropriately coupled to electrical control unit 38 so as to provide appropriate potential differences between anodes and cathodes supported on the rods to cause current to flow within electrolytic solution 30 to cause plating to occur, as more fully described below in detail.

In order to heat electrolytic solution 30 to a desired temperature, a hollow heating coil 60 is positioned proximate bottom wall 24*a* of tank 24. Coil 60 is preferably formed of a steam-heated, coated, titanium coil, and allows for heat transfer through electrolytic solution 30 from bottom to top. Coil 6 is appropriately coupled through coil extensions 60*a* and 60*b* to external steam heating lines.

Figure 3:
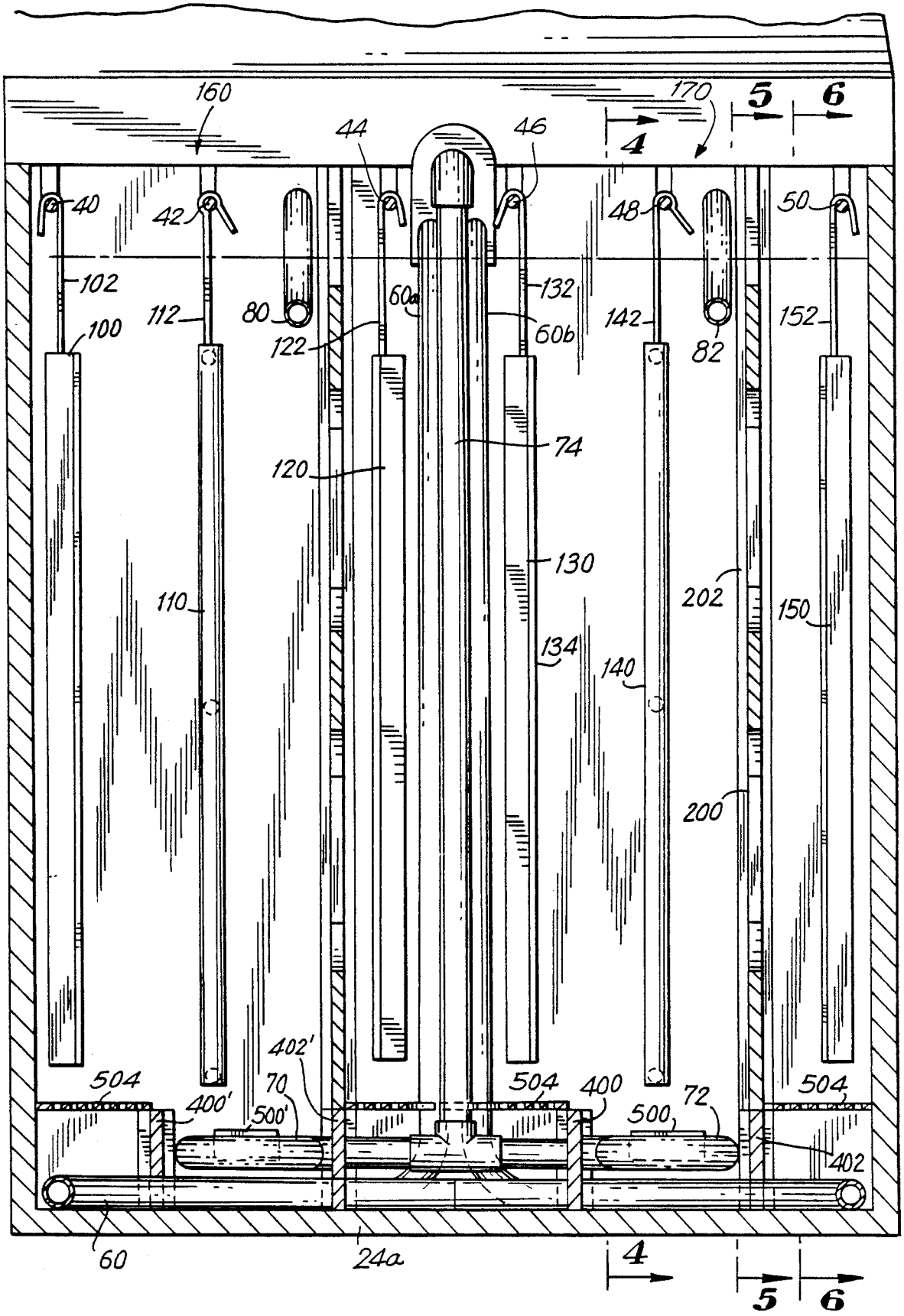
FIG. 3 is a sectional view taken along line 3—3 of FIG. 2.

Pumping system 36 includes a sparger system within front compartment 24. The sparger system includes two elongated, essentially rectangular sparger pipes 70 and 72 positioned above heating coil 60 within front compartment 24. Rectangular sparger pipes 70 and 72 include a plurality of openings 71 and 73, respectively, on the upper surfaces 70*a* and 72*a* thereof. respectively, to permit the electrolytic solution to be pumped in an upward direction by pumping system 36. As best seen in FIGS. 2 and 3, rectangular sparger 70 is positioned below rod 42 and extends essentially parallel thereto. Likewise, rectangular sparger unit 72 is positioned below rod 48 and extends essentially parallel thereto. A centrally located pipe 74 couples sparger units 70 and 72 to pumping system 36.

In order to complete pumping system 36, first and second intake pipes 80 and 82 extend from pumping system 36 into tank 24. Accordingly, electrolytic solution 30 is taken into the pumping system 36 through intake pipes 80 and 82, is circulated through pumping system 36 which includes a flow sensor positioned at 87 coupled to an external flow meter 88, appropriate filters, and valves, and is then forced into rectangular sparger units 70 and 72, and hence through openings 71 and 73 therein so as to be forced upwardly to create the desired circulation pattern. Using such flow meter and associated valves, flow rate through the sparger system can be kept at a desired level.

Pump 34 is preferably a centrifugal pump. The pipes of piping system 36 are preferably formed from a series of chlorinated polyvinylchloride (CPVC) pipes, as depicted.

To best describe the electrical configuration within front compartment 24, reference is initially made to FIG. 3. In FIG. 3, it is seen that first electrically conductive rod 40 supports a first anode block 100 by means of conductive hooks 102. Conductive rod 42 supports a first cathode fixture rack 110 by means of conductive hooks 112. A second anode block 120 is supported on electrically conductive rod 44 by means of conductive hooks 122. A third anode block 130 is supported on conductive rod 46 by means of conductive hooks 132. A second cathode fixture rack 140 is supported on electrically conductive rod 48 by means of conductive hooks 142. Finally, a fourth anode block 150 is supported on electrically conductive rod 50 by means of conductive hooks 152. Conductive hooks 102, 112, 122, 132, 142 and 152 are preferably formed from titanium.

The aforedescribed configuration of front compartment 24 permits two cathode fixture racks 110 and 140 to be utilized at the same time. The left rack system generally, indicated at 160, including first and second anode blocks 100 and 120, first cathode fixture rack 110 and left sparger unit 70 and other components is a duplicate of right rack system 170 including third and fourth anode blocks 130 and 150, second cathode rack 140 and right sparger unit 72 and other components. Accordingly, only the configuration of right tank system 170 will be described in detail below.

As best depicted in FIG. 1, it is seen that cathode fixture rack 140 can be moved up and down in the direction of arrows A to permit insertion of fixture rack 140 into tank 24 and removal of fixture rack 140 from tank 24 after the plating process has been completed. Cathode fixture rack 140 is defined by two vertical parallel legs 143*a* and 143*b* joined together by three horizontal legs 145*a*, 145*b* and 145*c*. The legs are electrically conductive and are covered by an appropriate non-conductive material. A plurality of posts 144 extend from each of the conductive legs forming cathode rack 140 to permit electrical connection of appropriate items such as jewelry pieces 180 to be plated. When placed on cathode rack 140, jewelry pieces 180 are wired together by a thin conductive wire 182 so that they can be coupled intermediate appropriate posts 144, as best depicted in FIG. 4.

Figure 4:
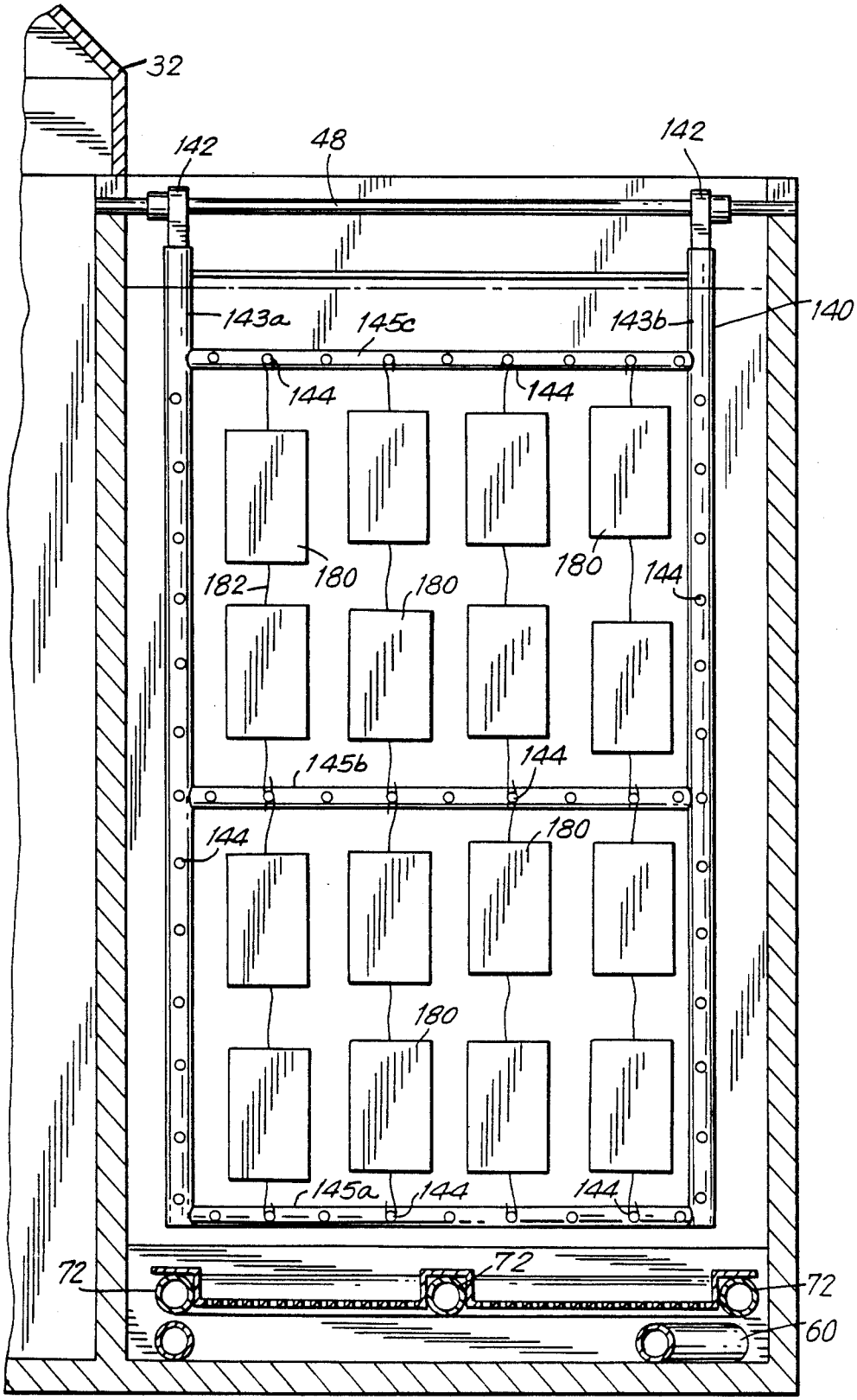
FIG. 4 is a sectional view taken along line 4—4 of FIG. 3.

From FIGS. 3 and 4, it is seen that when cathode fixture rack 140 is supported on conductive rod 48, it extends intermediate the elongated pipes of sparger unit 72 so that when the electrolytic solution is forced out of openings 73, it will pass on both sides of rack 140 to insure that an appropriate amount of ion rich plating solution is presented to the jewelry piece surfaces to be plated.

Figure 6:
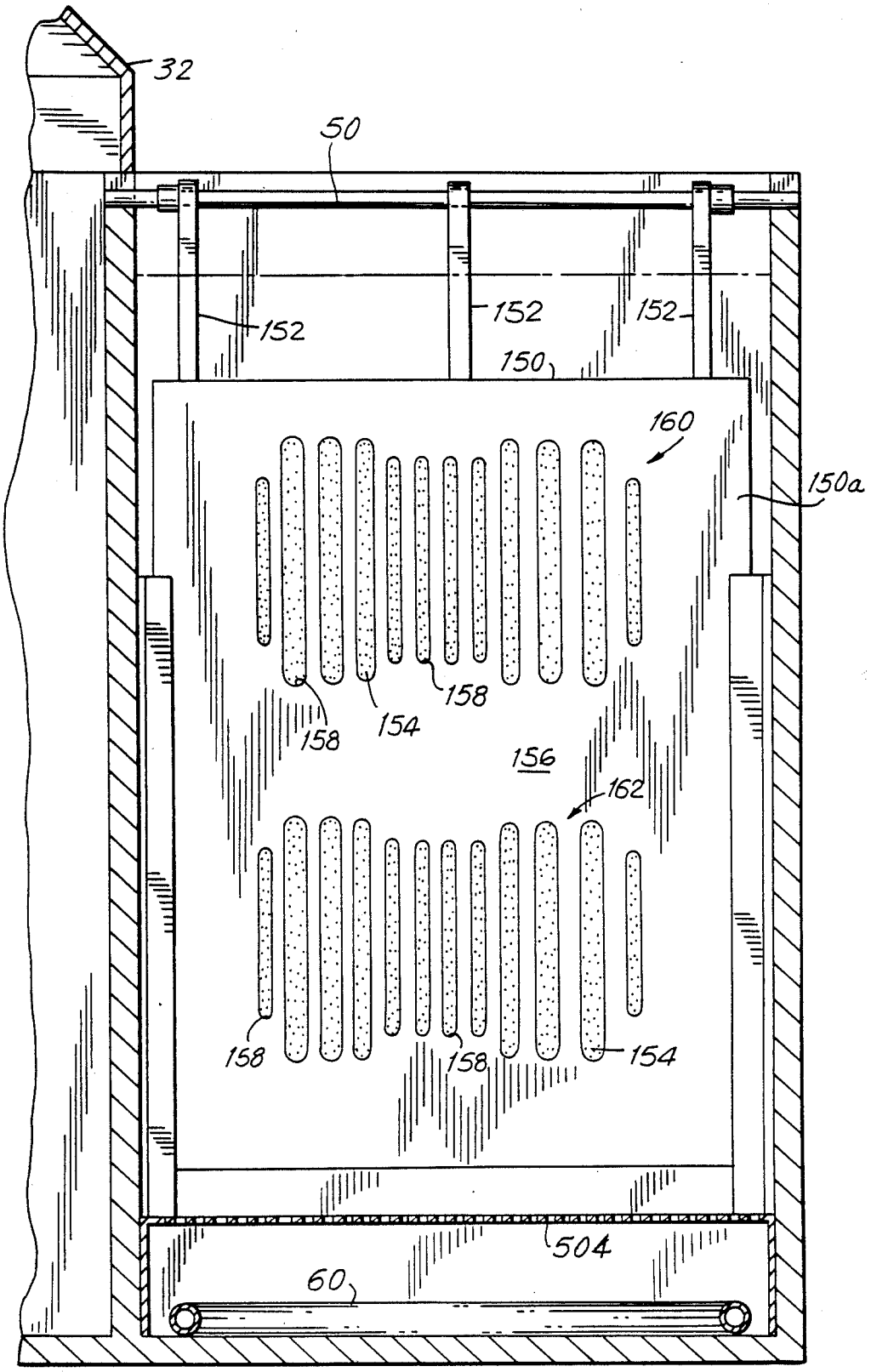
FIG. 6 is a sectional view taken along line 6—6 of FIG. 3.

As best seen in FIG. 6, anode block 150 is formed of a flat, solid, graphite block 154, covered by a plastic material 156. Two sets 160 and 162 of substantially rectangular openings 158 of varying lengths and widths in a symmetrical pattern are formed on front plastic surface or anode mask 150*a* of anode block 150. The back and sides of anode plate 150 are otherwise electrically sealed. Front plate 150*a* defines an anode mask preferably made of a non-conducting polypropylene material. Openings 158 permit control of the direction of the electrical field towards cathode fixture rack 140.

Anode block 130 positioned on the opposite side of cathode fixture rack 140 is constructed similarly to anode rack 150 and includes openings 158 on the front surface 134 thereof in two sets. Anode block 130 and anode block 150 are positioned essentially equidistant from cathode rack 140.

Figure 5:
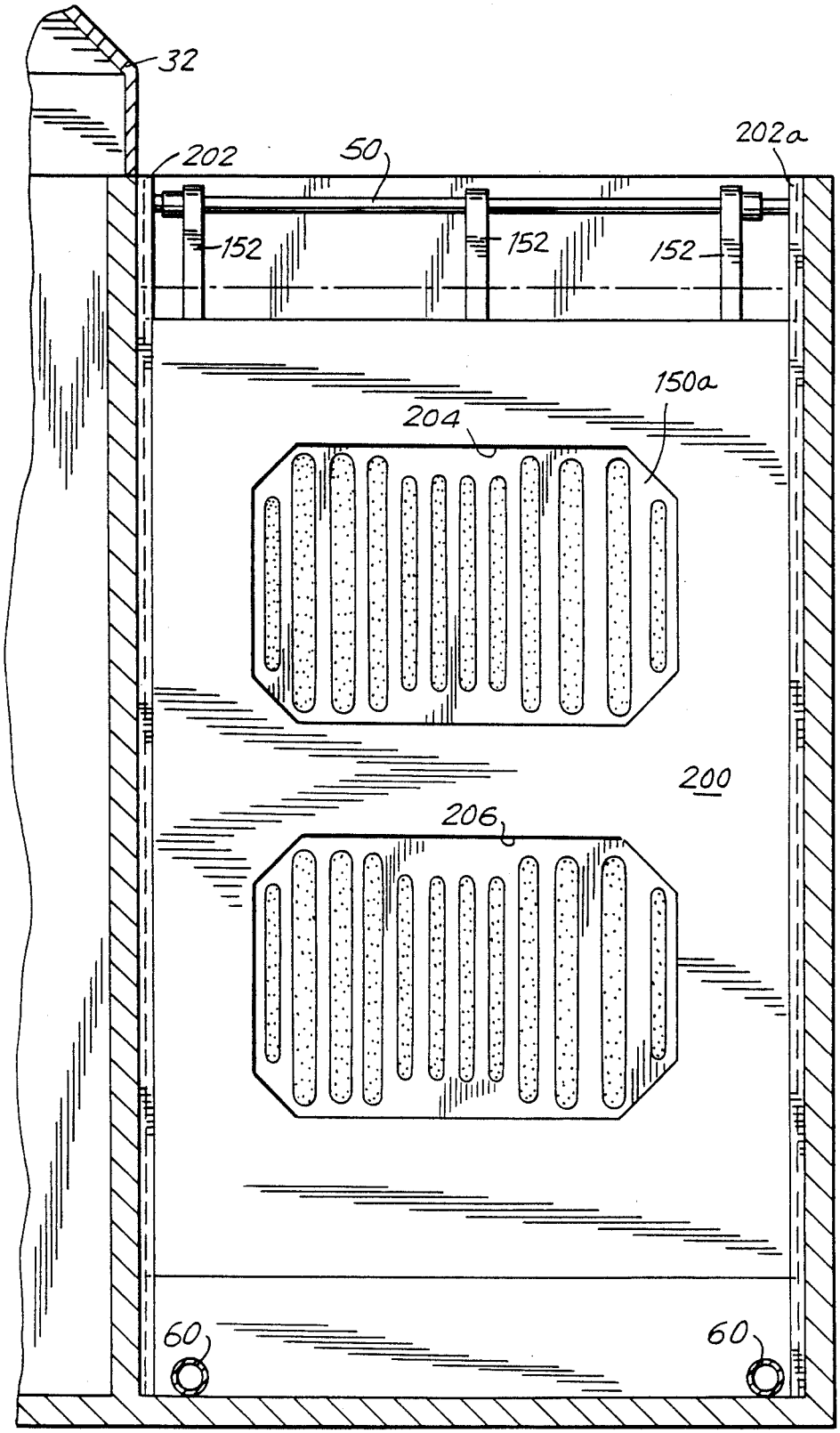
FIG. 5 is a sectional view taken along line 5—5 of FIG. 3.

A non-conductive screen 200 is positioned within tracks 202 and 202*a* disposed on opposing side walls of front compartment 24 as best depicted in FIGS. 2 and 5. Anode screen 200 is formed from a non-conducting material such as polypropylene and includes two essentially rectangular enlarged openings 204 and 206 in alignment respectively with both sets of openings 158 in anode mask 150*a*. Screen 200 acts to further direct and concentrate the electrical field between anode blocks 130 and 150 and cathode fixture rack 140 to improve plating uniformity thereon.

Sparger unit 72 is sandwiched between non-conducting electric shields or plates 400 and 402 supported in tracks on the walls of the tank. Plates 400 and 402 act to minimize higher plating thicknesses at the bottom of the jewelry rack fixture. A removable titanium catch basket 500 is positioned in the space between the legs forming sparger unit 72 for holding loose jewelry which has fallen off of the rack for later easy retrieval. Other portions of the bottom of tank 24 are lined with a mesh 504 to prevent items from falling to the bottom wall of the tank.

Figure 7:
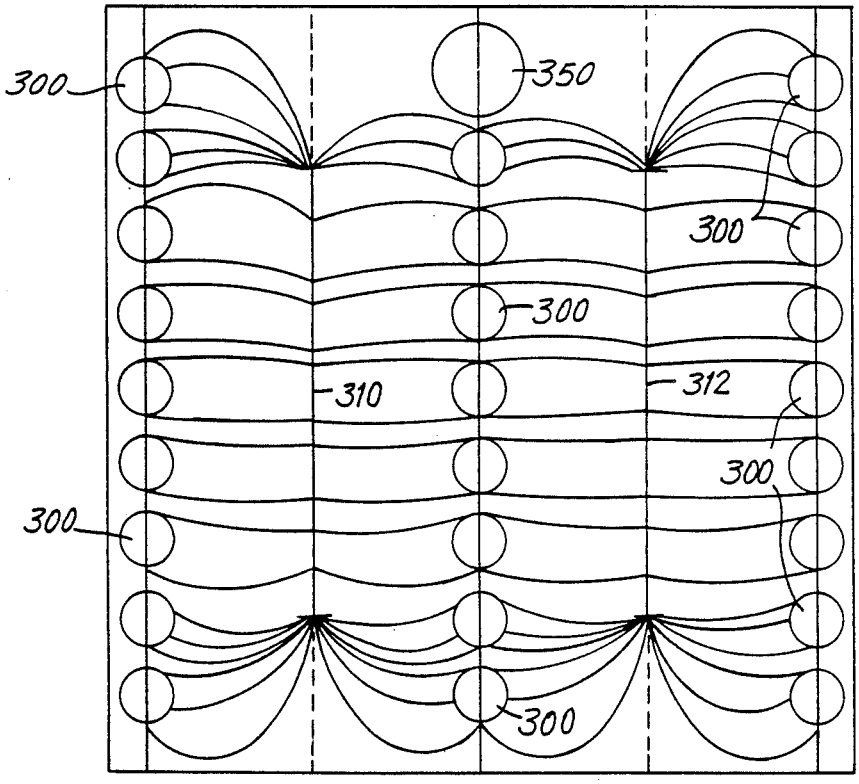
FIG. 7 PRIOR ART
FIG. 7 is a diagrammatic representation showing the electrical field lines in an electroplating tank constructed according to the prior art.
Figure 8:
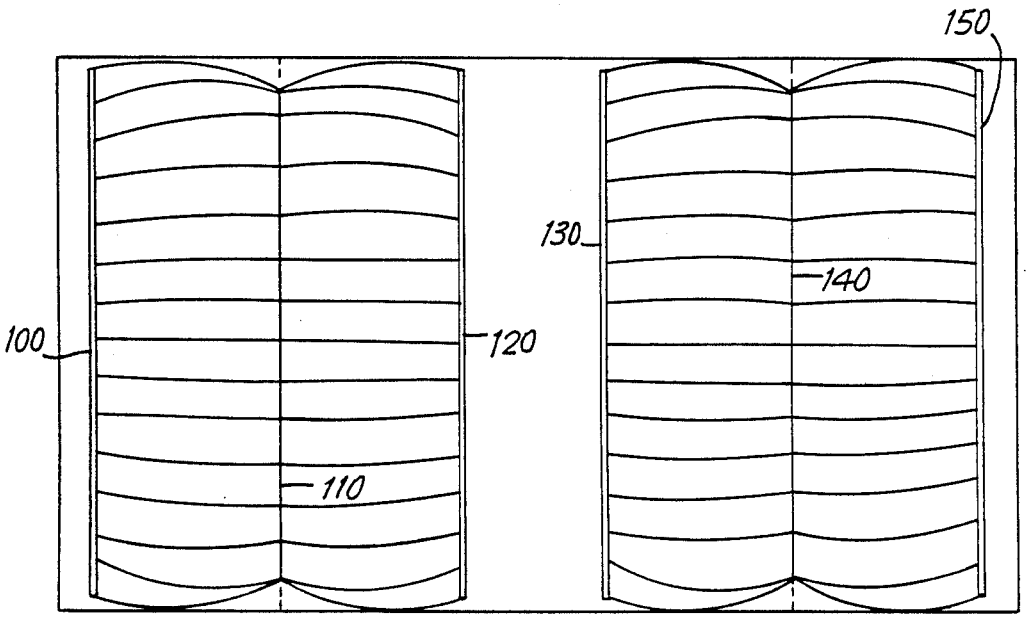
FIG. 8 is a diagrammatic representation showing the electrical field lines in an electroplating tank constructed according to the present invention.

In order to appreciate the effect of using the anodes, anode mask, screen and cathode fixture rack configuration as described in detail above, reference is made to FIGS. 7 and 8. FIG. 7 depicts the field lines produced in a conventional electroplating tank utilizing a plurality of anode rods 300 positioned on opposite sides of two cathode racks 310 and 312. Due to the corona effect, it is seen that the electrical field lines concentrate at the edges of the cathode fixture rack resulting in jewelry pieces on the edges of such a rack having a higher plating thickness than those in the center of the rack which have a substantially lower plating thickness. For example, standard gold tanks may suffer from a thickness distribution variance of more than 11.5%. This results in the wasting of gold and significant increase in costs associated with manufacturing items of jewelry.

In contradistinction thereto, FIG. 8 depicts the more uniform lines of electrical field distribution utilizing the electroplating tank configuration according to the present invention. It has been found that the present invention provides a thickness distribution variance of only about 5.7%. This at least 50% distribution improvement allows for tighter thickness control, thereby meeting the minimum thickness requirements at lower mean thicknesses so as to achieve a substantial gold savings with substantially no quality rejects for underplating.

Figure 9:
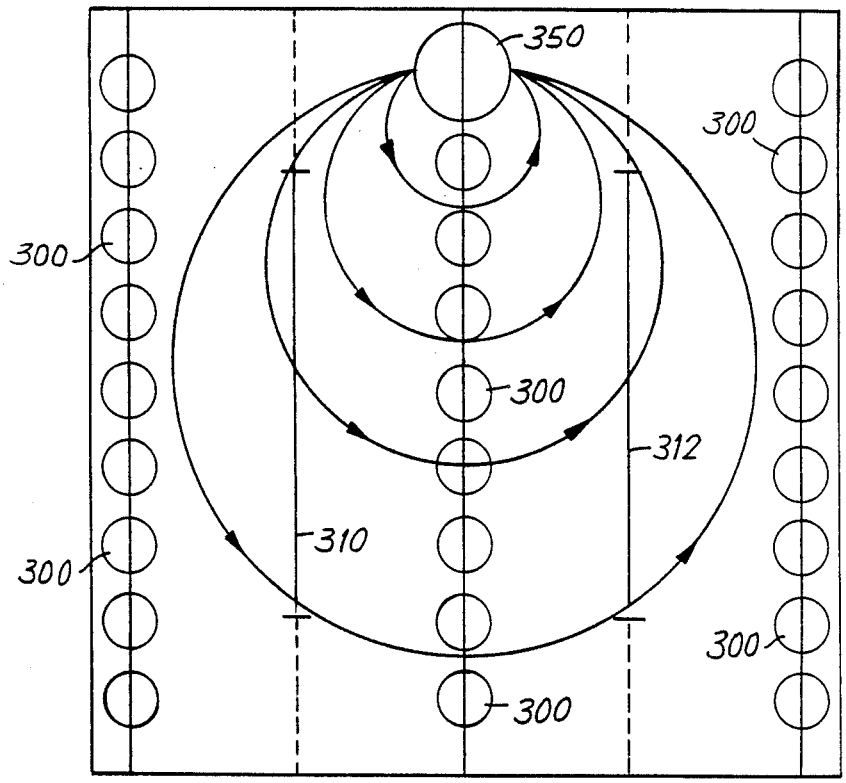
FIG. 9 PRIOR ART
FIG. 9 is a diagrammatic representation showing the direction of fluid flow in an electroplating tank constructed according to the prior art.
Figure 10:
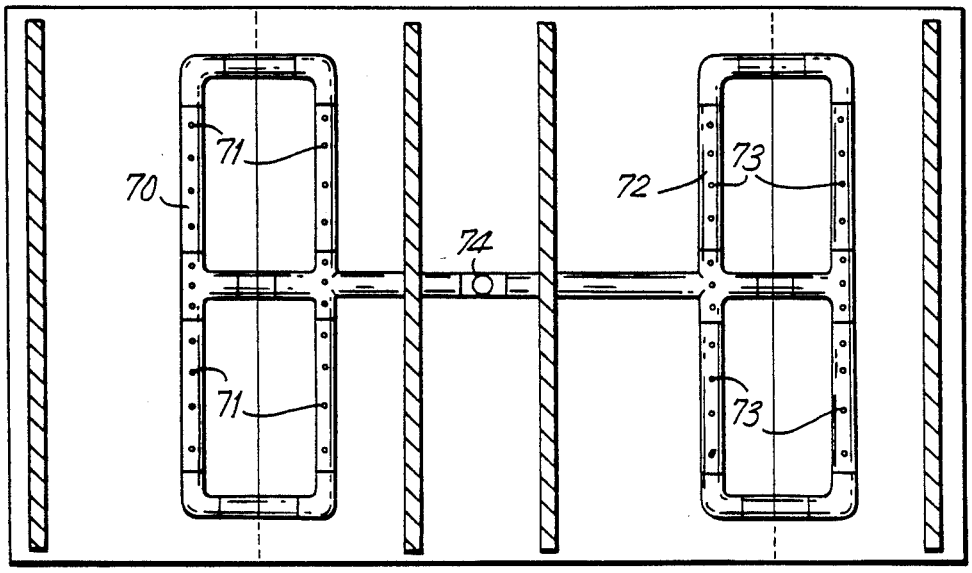
FIG. 10 is a top plan view of the sparger system utilized in the present invention to direct flow of electroplating solution in the electroplating tank constructed according to the present invention.

FIGS. 9 and 10 depict the fluid flow patterns in a conventional system (FIG. 9) and in the system according to the present invention (FIG. 10). In FIG. 9, it is seen that in conventional systems, a pump 350 which produces a circular fluid flow pattern within the prior art tank does not present a uniform flow of electroplating solution onto cathode racks 310 and 312. Moreover, the flow pattern from the front to back of cathode racks 310 and 312 is significantly different resulting also in different plating thicknesses on the front and back of jewelry items.

On the other hand, as depicted in FIG. 10, spargers 70 and 72 are positioned so as to provide a uniform flow of electrolytic material over the front and rear surfaces of the cathode rack 110 and 140 to insure that a sufficient amount of plating solution passes over the front and back surfaces to further enhance the uniformity of the plating process.

In a preferred embodiment of the present invention, the following parameters are utilized:

1. Type of electrolytic solution - acid gold solution
2. Temperature of solution - 125° F.
3. Dimensions of front tank compartment - length=20"; width=32"; height=40"
4. Size of openings in sparger - ⅛" diameter
5. Distance between each anode and cathode fixture rack is 6", distance between screen and adjacent anode is 3".
6. Pressure provided by pump - 240 PSI using 1 hp pump
7. Voltage applied across anodes and cathode - 5 V(DC)
8. Current applied by Rectifier - 50 amp per sq. ft. (50ASF)
9. Flow rate - 7.5 gallons per minute The presently described electroplating tank exhibits substantial improvement in thickness distribution over a rack of jewelry and over a plating tank resulting in substantial savings. The constructions described above can be utilized for all electroplating processes including those utilizing an electrolytic gold solution, rhodium solution or nickel solution for the plating of gold, rhodium or nickel on the items to be plated. It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. An electroplating apparatus for electroplating a plurality of items on a rack, comprising a tank having a bottom wall and side walls adapted to hold a predetermined quantity of an electrolytic plating solution defining a top level, sparger means positioned proximate the bottom wall of said tank for directing said electrolytic plating solution upward in a direction generally parallel to said side walls of said tank, intake pipe means positioned proximate the top level of said tank essentially directly above said sparger means in said electrolytic plating solution for removing said electrolytic plating solution from said top level of said tank when directed upward by said sparger means, pump means coupled to said sparger means and said intake pipe means for circulating said electrolytic plating solution through said sparger means and into said intake pipe means, conductive rack means forming a cathode having first and second opposed sides for supporting said plurality of items thereon, support means positioned on said tank for releaseably supporting said rack means to extend upwardly from said sparger means, first anode means extending essentially parallel to and facing said first side of said rack means and positioned in said tank a predetermined distance from said rack means, second anode means extending essentially parallel to and facing said second side of said rack means and spaced essentially said predetermined distance from said rack means, screen means positioned intermediate said rack means and said first anode means for directing the current from said first and second anode means towards said rack means, said rack means and said first and second anode means being coupleable to voltage means for applying a predetermined voltage across said first and second anode means and said cathode rack means, whereby items supported on said rack means are electroplated.

2. The electroplating apparatus as claimed in claim 1, further comprising heating coil means positioned proximate the bottom wall of said tank for heating said electrolytic plating solution to a predetermined temperature.

3. The electroplating apparatus as claimed in claim 1, wherein said tank is formed from a non-conductive plastic material.

4. The electroplating apparatus as claimed in claim 3, wherein said plastic material is polypropolyene.

5. The electroplating apparatus as claimed in claim 1, wherein said tank includes a front tank compartment and a rear tank compartment, and divider means for dividing said tank into said front and rear compartments.

6. The electroplating apparatus as claimed in claim 5, wherein said divider means is a plate formed from a plastic material.

7. The electroplating apparatus as claimed in claim 6, wherein said front tank compartment houses said sparger means, intake pipe means, rack means, support means, first and second anode means and said screen means, and said second compartment houses said pump means.

8. The electroplating apparatus as claimed in claim 1, wherein said sparger means includes an essentially rectangular pipe configuration having elongated legs with a top surface, and a plurality of openings formed in said top surface of said legs, said pump means pumping said electrolytic solution through said opening in an upward direction, said intake pipe means being positioned essentially directly above said rectangular pipe configuration to receive said electrolytic solution pumped upwardly from said sparger means.

9. The electroplating apparatus as claimed in claim 8, wherein said rack means is positioned intermediate said elongated legs of said rectangular pipe configuration and adjacent said intake pipe means whereby said electrolytic solution is directed along said first and second opposed sides of said rack means.

10. The electroplating apparatus as claimed in claim 1, wherein said first anode means is an anode block having a front surface facing said first side of said rack means and formed from a conductive material covered by a non-conductive plastic material having a plurality of at least first openings in said front surface to define an anode mask.

11. The electroplating apparatus as claimed in claim 10, wherein said at least first openings in said front surface of said anode block are essentially rectangular in shape.

12. An electroplating apparatus for electroplating a plurality of items on a rack, comprising a tank having a bottom wall and side walls adapted to hold a predetermined quantity of an electrolytic plating solution, sparger means positioned proximate the bottom wall of said tank for directing said electrolytic plating solution in a direction generally parallel to said side walls of said tank, pump means coupled to said sparger means for circulating said electrolytic plating solution through said sparger means, conductive rack means forming a cathode having first and second opposed sides for supporting said plurality of items thereon, support means positioned on said tank for releaseably supporting said rack means to extend upwardly from said sparger means, first anode means extending essentially parallel to and facing said first side of said rack means and positioned in said tank a predetermined distance from said rack means, second anode means extending essentially parallel to an facing said second side of said rack means and spaced essentially said predetermined distance from said rack means, screen means positioned intermediate said rack means and said first anode means for directing the current from said first and second anode means towards said rack means, said rack means and said first and second anode means being coupleable to voltage means for applying a predetermined voltage across said first and second anode means and said cathode rack means, whereby items supported on said rack means are electroplated, said first anode means being an anode block having a front surface facing said first side of said rack means and formed from a conductive material covered by a non-conductive plastic material having a plurality of at least first openings in said front surface to define an anode mask, said at least first openings in said front surface of said anode block being essentially rectangular in shape, said front surface of said anode block including a second set of essentially rectangular openings positioned below said first set of openings in said front surface.

13. The electroplating apparatus as claimed in claim 12, wherein said first and second sets of rectangular openings extend in a longitudinal direction essentially parallel to the side walls of said tank.

14. The electroplating apparatus as claimed in claim 13, wherein said first and second sets of rectangular openings vary in width and length.

15. The electroplating apparatus as claimed in claim 12, wherein said screen means includes two enlarged through holes positioned in alignment with said first and second sets of rectangular openings.

16. The electroplating apparatus as claimed in claim 12, wherein said second anode means is an anode block having a front surface facing said second side of said rack means and formed from a conductive material covered by a non-conductive plastic material having first and second sets of openings in alignment with the first and second sets of openings in said first anode means.

17. The electroplating apparatus as claimed in claim 12, further comprising first and second non-conductive shield plates positioned proximate the bottom of said tank on opposite sides of said sparger means.

18. The electroplating apparatus as claimed in claim 12, further comprising basket means positioned at the bottom of said tank for catching items which fall off of said rack means.

19. The electroplating apparatus as claimed in claim 12, wherein said tank means is sized to support a second rack means and third and fourth anode means on opposite sides thereof in series with said first rack means, whereby two racks of items may be plated at the same time in the tank.

20. The electroplating apparatus as claimed in claim 19, further comprising second screen means intermediate said second rack means and said third anode means.

21. An electroplating apparatus for electroplating a plurality of items on first and second conductive racks, comprising a tank having a bottom wall and side walls adapted to hold predetermined quantity of an electrolytic plating solution, a first support rod for releaseably holding said first rack in said tank and a second support rod for releaseably holding said second rack in said tank, first and second sets of first and second anode blocks positioned respectively on opposite sides of said first and second racks, said first and second anode blocks in said first set each having a front surface facing said first rack means, said first and second anode blocks in said second set each having a front surface facing said second rack, said front surfaces having a plurality of elongated openings therein to direct current respectively towards said first and second racks, a first non-conductive screen positioned intermediate said first rack and said first anode block in said first set and a second non-conductive screen positioned intermediate said second rack and said first anode block in said second set, said first and second screens having enlarged through holes in alignment with the openings in said anode blocks, a first sparger having openings facing said first rack positioned below said first rack and a second sparger having openings facing said second rack positioned below said second rack, and pump means for pumping said electrolytic solution through said first and second spargers towards said first and second racks, said anode blocks and racks being coupleable to a voltage source for applying a potential difference therebetween to cause said items on said racks to be electroplated.

22. The electroplating apparatus as claimed in claim 21, further comprising heating coil means positioned proximate the bottom wall of said tank for heating said electrolytic plating solution to a predetermined temperature.

* * * * *